US006588185B1

(12) United States Patent
Goblet

(10) Patent No.: US 6,588,185 B1
(45) Date of Patent: Jul. 8, 2003

(54) SADDLETREE ALLOWING EXCHANGEABILITY OF PARTS OF A SADDLE, AND A SADDLE COMPRISING SUCH A SADDLETREE

(75) Inventor: Laurent Goblet, Paris (FR)

(73) Assignee: Hermes Sellier, Paris (FR)

( * ) Notice: Subject to any disclaimer, the term of this patent is extended or adjusted under 35 U.S.C. 154(b) by 0 days.

(21) Appl. No.: 09/693,318

(22) Filed: Oct. 20, 2000

(51) Int. Cl.[7] ..... B68C 1/04
(52) U.S. Cl. ..... 54/44.3
(58) Field of Search ..... 54/44.1, 44.3, 54/44.5, 44.7, 46.1, 38.1, 42.1

(56) References Cited

U.S. PATENT DOCUMENTS

| | | | | | |
|---|---|---|---|---|---|
| 63,322 | A | * | 3/1867 | Spurgin | 54/44.4 |
| 70,425 | A | * | 11/1867 | Dixon | 54/44.1 |
| 1,610,989 | A | * | 12/1926 | Aguilar | 54/37.1 |
| 3,153,887 | A | * | 10/1964 | Bohlin | 54/46.2 |
| 3,835,621 | A | * | 9/1974 | Gorenschek | 54/44.7 |
| 4,265,075 | A | * | 5/1981 | Motsenbocker | 54/44.5 |
| 4,965,988 | A | * | 10/1990 | Anderson | 54/44.7 |
| 5,191,752 | A | * | 3/1993 | Murphy | 54/44.5 |

FOREIGN PATENT DOCUMENTS

| | | | | |
|---|---|---|---|---|
| DE | 2329436 | * | 6/1973 | B68C/1/02 |
| DE | 3702011 | * | 3/1988 | B68C/1/02 |
| DE | 3902305 A1 | * | 8/1990 | B68C/1/04 |
| GB | 2071986 A | * | 9/1981 | B68C/1/02 |
| GB | 2330513 | * | 4/1999 | B68C/1/02 |
| WO | 98/06662 | * | 2/1998 | B68C/1/02 |

* cited by examiner

*Primary Examiner*—Peter M. Poon
*Assistant Examiner*—Son T. Nguyen
(74) *Attorney, Agent, or Firm*—Perman & Green, LLP

(57) ABSTRACT

A saddletree (2) intended for producing a saddle, notably for horses, which has at least one single-piece part (13) forming a pommel (14), a cantle (15), a base (16) and a support for constituent parts of the saddle, this single-piece part being produced from materials, such as composite materials, chosen for their suitability for being shaped to the required shape for the saddletree, for conferring on the saddletree the necessary qualities of strength and elasticity and for allowing the incorporation in the saddletree of members (21) for the removable positioning and fixing of other constituent parts of the saddle, in order to adapt the saddle to the requirements expressed.

14 Claims, 10 Drawing Sheets

SADDLETREE ALLOWING EXCHANGEABILITY OF PARTS OF A SADDLE, AND A SADDLE COMPRISING SUCH A SADDLETREE

FIELD OF THE INVENTION

The invention relates to saddles for horses and concerns a saddletree and a saddle having such a saddletree.

A saddle for a horse conventionally has, connected together, a strength piece known as the saddletree, a seat, two stirrup oars or stirrup carriers, two panels, two flaps and knee rolls, and girth leathers; and attached removable components, girths, surcingles, stirrup leathers and

STATE OF THE ART

In conventional designs, the saddletree is composed of several pieces connected together, namely two longitudinal wooden pieces, two curved pieces forming respectively the pommel and the cantle, generally in the form of a flat metallic bar, connecting the longitudinal wooden pieces and rigidly fixed to them; girths placed on the above pieces; and finally a cloth fixed over the girths. The other constituent parts of the saddle are fixed to the saddletree by studding, stitching or the like, that is to say by permanent fixing means.

The document DE 37 02 011 describes a saddletree which comprises a piece made of plastics material arid a kind of frame fixed to the plastic piece removably, supporting the other parts making up the saddle.

The document DE 2 329 436 concerns a cellular plastics material. The document GB 2 227 638 concerns a saddle of the conventional type, part of which is produced from plastics material.

The need has been felt to be able to replace constituent parts of the saddle easily whilst avoiding this being made complicated because of the permanent fixing of the part.

The need has also been felt to be able to assemble a saddle from its constituent parts more simply, avoiding operations of studding or stitching which are lengthy, tricky and expensive.

Finally, the need has been felt to reduce the weight of a saddle of traditional appearance in order to adapt it to sports riding activities.

SUMMARY OF THE INVENTION

To this end, a first object of the invention is a saddletree intended for producing a saddle, notably for a horse, having a single-piece strength part forming a pommel, a cantle, a base and a support for the other constituent parts of the saddle.

According to the invention, the saddletree comprises essentially the single-piece part, which is produced from materials, such as composite materials, chosen for their suitability for being shaped to the required form for the saddletree, to confer on the saddletree the required qualities of strength and flexibility and to provide the incorporation in the peripheral pact of the strength piece a plurality of removable positioning and fixing members, for the other constituent parts of the saddle (panels, flaps, knee rolls, girth leathers, padding, seat, skirts, pommel and cantle backplates etc) in the form of holes, spikes, hollow recesses, reliefs, screwing inserts, buckles or the like, so that the said constituent parts of the saddle are positioned and fixed to the part by virtue of the members.

Another object of the invention is a saddle, notably for a horse, comprising a saddletree comprising essentially the single-piece strength piece provided with any removable positioning and fixing members as well as two stirrup bars, incorporated or not into the single-piece part of the saddletree, two panels fixed against the internal face of the saddletree, where applicable, one or more pieces for padding the external face of the saddletree, two flaps and two knee rolls disposed laterally, two girth leathers disposed laterally towards the pommel and a piece forming a seat covering the external face of the saddletree, the panels, the padding piece or pieces, the flaps and knee rolls, the girth leathers and the piece forming a sear being provided with removable fixing members complementary to the positioning and fixing members incorporated in the saddletree piece.

THE DRAWINGS

The other characteristics of the saddletree and saddle will emerge from the description with reference to the accompanying drawings, in which.

DETAILED DESCRIPTION

Figure 1:
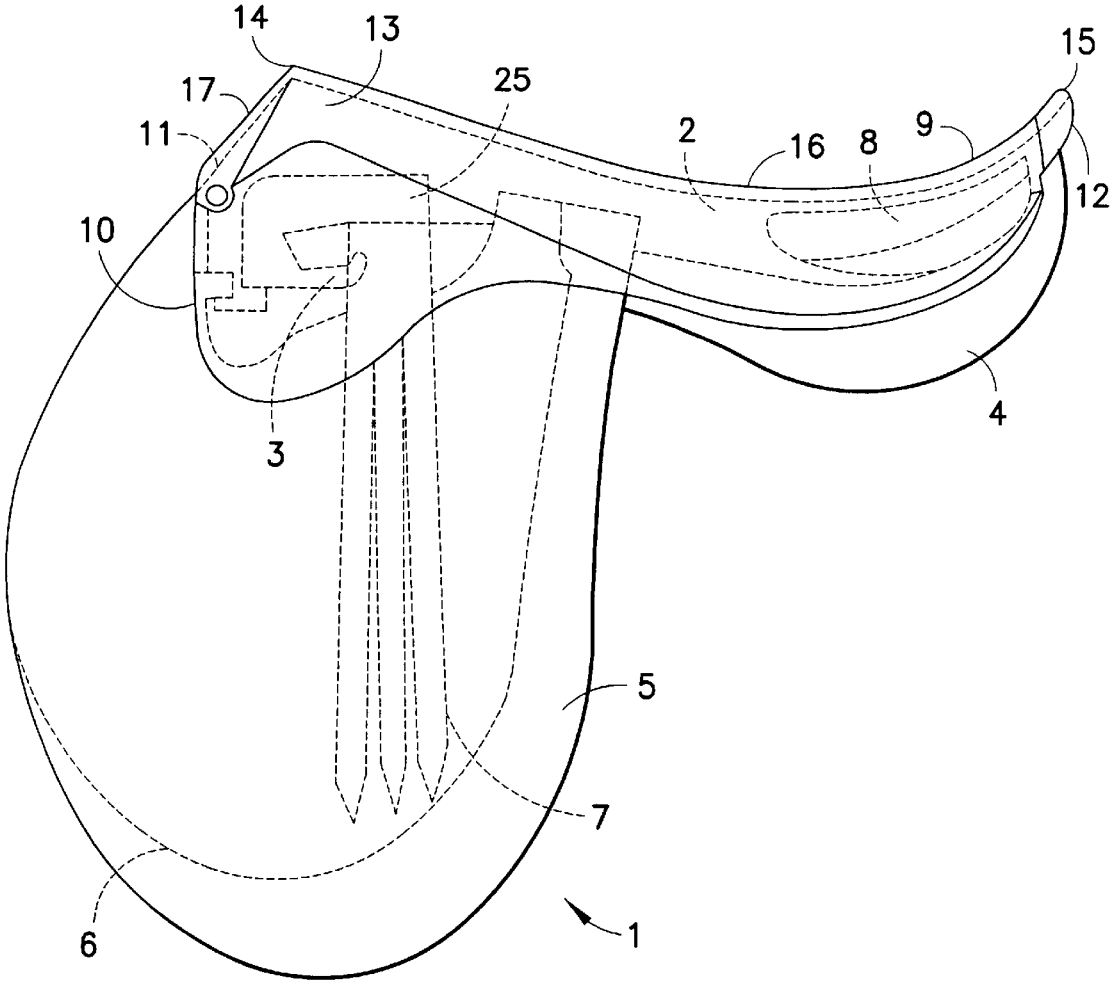
FIG. 1 is a view in longitudinal elevation of a saddle, constituent parts of the saddle being depicted in broken lines.
Figure 18:
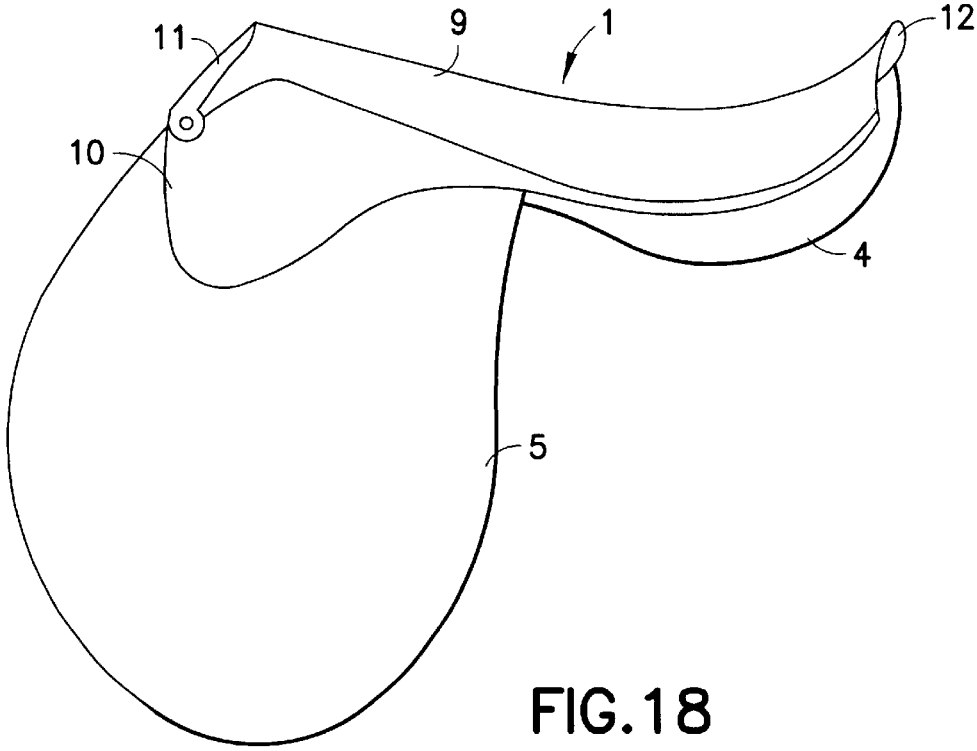
FIG. 18 is a longitudinal elevation vies of a saddle.

Hereinafter, a saddle according to the invention is described in its normal position of use, where it rests on the back of a horse. A "longitudinal" direction is substantially merged with the direction of the backbone of the horse. With respect to this direction, substantially horizontal, the "front" designates a location towards the head of the horse, and the "rear" a location towards the rump. A "transverse" direction is substantially horizontal and at right angles to the longitudinal direction. The term "laterally" is defined with respect to this direction. An elevation direction is substantially vertical and perpendicular to the longitudinal and transverse directions. The terms "top" and "bottom" are defined with respect to this direction. The inside designates a location close to the body of the horse and the outside a location further away. A saddle 1, as depicted in FIGS. 1 and 18, comprises an internal saddletree 2, which is the main strength part of the saddle, and a certain number of pares supported by the saddletree 2, namely notably:

- two stirrup-leacher carriers or stirrup bars 3;
- at least one panel 4, notably two;
- two flaps 5 and knee rolls 6;
- girth leathers 7;
- at least one, and for example two stuffing pieces known as padding 8;
- a seat 9;
- two skirts 10 made in one piece with the seat; and
- two backplates 11 and 12 respectively for the pommel and cantle.

The skirts 10, the flaps 5 and knee rolls 6, all lateral, are placed one against the other from the outside of the saddle 1 towards the inside, that is to say towards the saddletree 2. The seat 9 covers the saddletree 2, being maintained on the latter notably by means of the backplates for the pommel 11 and cantle 12. The saddle 1 rests on the back of the horse through the panels 4 fixed laterally to the inside of the saddletree 2.

The configuration of the saddle 1 provides a longitudinal passage for the backbone of the horse, under the saddletree 2 and between the panels 4, so that no component making up the saddle 1 comes into contact with the backbone. This also distributes the force due to the weight of the rider on the back of the horse, whilst attenuating it.

The saddletree 2 (FIGS. 4 to 8) consists essentially of a single-piece part 13 forming the pommel 14, the cantle 15, the base 16 and a support for the other constituent parts of the saddle 1.

This single-piece part 13 is produced from a composite material such as a resin with a carbon fiber and/or glass fiber filler, a material comprising polyamide fibers, or the like.

According to one design, the part 13 also incorporates stiffening elements, such as a structure made from yarn, a cloth, a lattice of metal or the like, aimed at forming a reinforcing frame.

Figure 3:
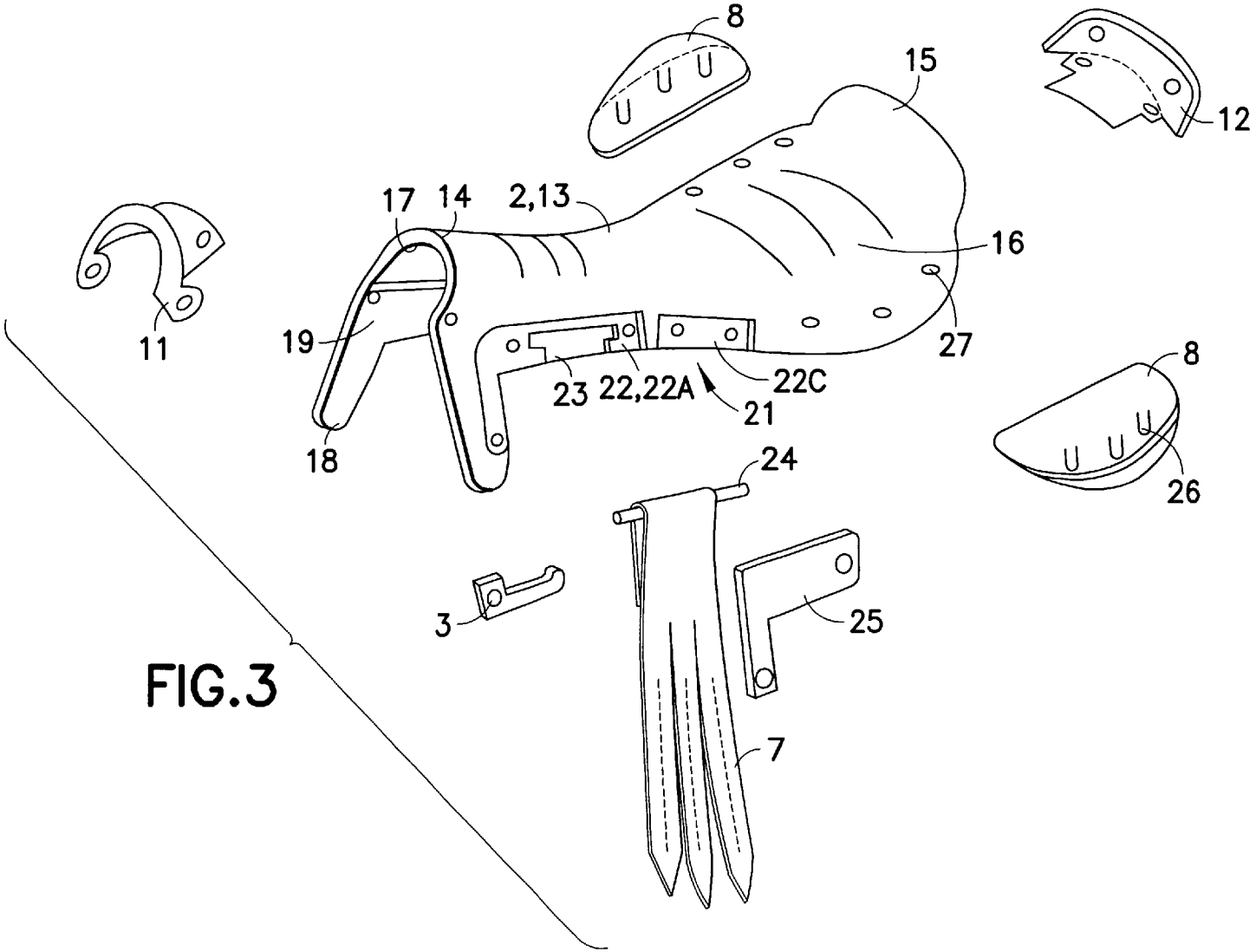
FIG. 3 is a view in exploder perspective of constituent parts of a saddle according to a second embodiment, where the stirrup bars are separate from the saddletree and attached.
Figure 5:
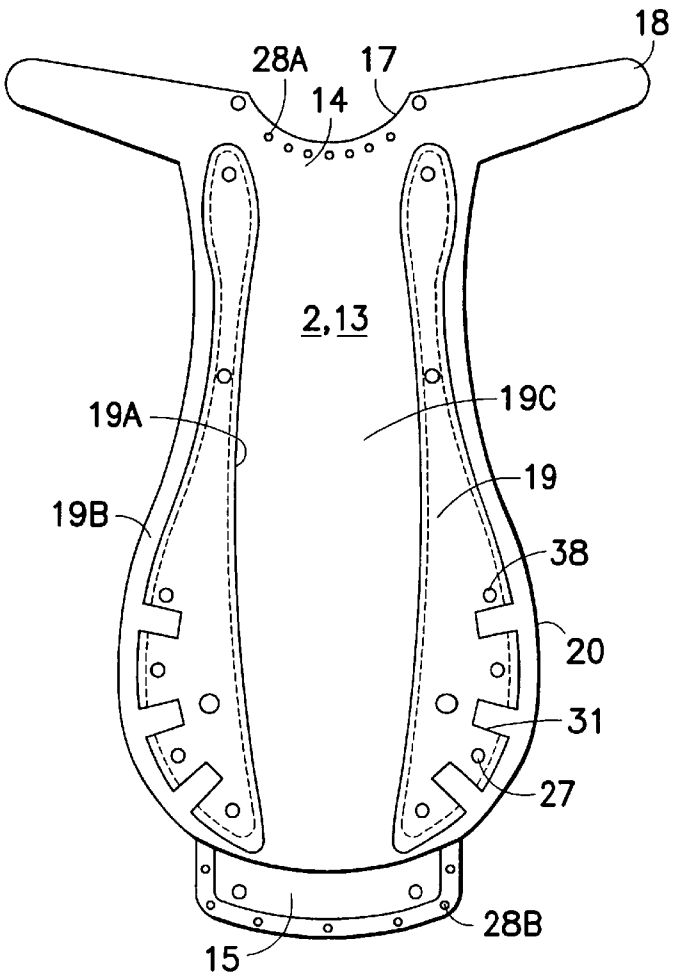
FIG. 5 is a plan view of a saddletree from below.

In one embodiment (FIG. 3), the stirrup bars 3 are parts separate from the single-piece part, and are fixed to the latter removably, towards the pommel 14.

The stirrup bars 3 are then produced from a strong rigid material, for example metal. Each stirrup bar 3 is intended to support an end part of the stirrup leather, each stirrup leather itself supporting a stirrup. The stirrup bars 3 have in elevation a general longitudinal L shape.

In another embodiment (FIG. 2), the piece 13 incorporates, at the time of manufacture, the stirrup bars 3, whose general shape is the same as that described above.

According to one embodiment, the saddletree comprises essentially the piece 13.

The general contour of the saddletree 2 is roughly close to the contour of a conventional saddletree. Transversely, the saddletree 2 has substantially the shape of a channel whose concavity is turned downwards. Longitudinally, its profile has a general curved shape, with its concavity turned upwards. These shapes are aimed at matching on the one hand the back of the horse and on the other hand the buttocks of a rider sitting on the saddle 1.

Close to its front end, the saddletree 2 comprises a pommel arch 17, extending substantially in a transverse elevation plane and extended by two saddletree tips 18 forming protrusions on the saddletree 2, from top to bottom, substantially in a longitudinal elevation plane. These tips 18 are intended to cooperate with the panel 4, in order to ensure their positioning on the saddletree 2. Close to its rear end, the saddletree 2 comprises a cantle 15 lying substantially in a transverse elevation plane, and projecting upwards from the saddletree 2. In one embodiment, the cantle 15 is substantially rectangular in shape.

Figure 4:
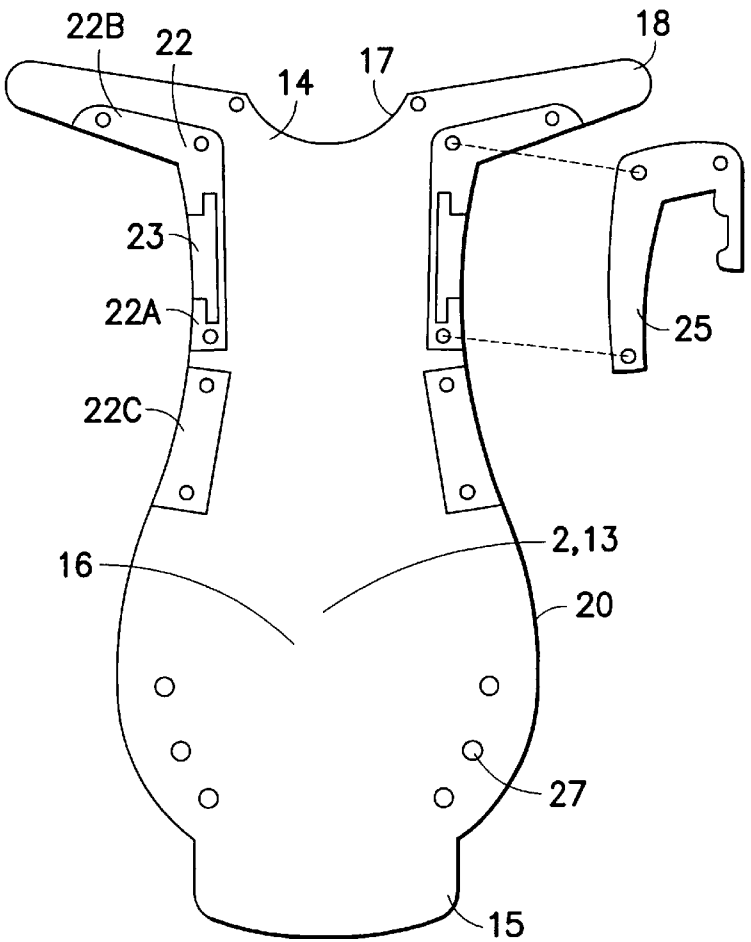
FIG. 4 is a plan view from above of a saddletree and a closure plate forming a stirrup bar.
Figure 6:
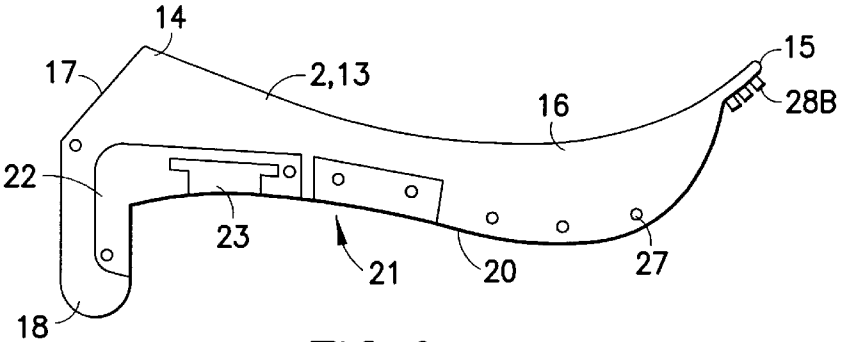
FIG. 6 is a longitudinal elevation view of a saddletree.
Figure 7:
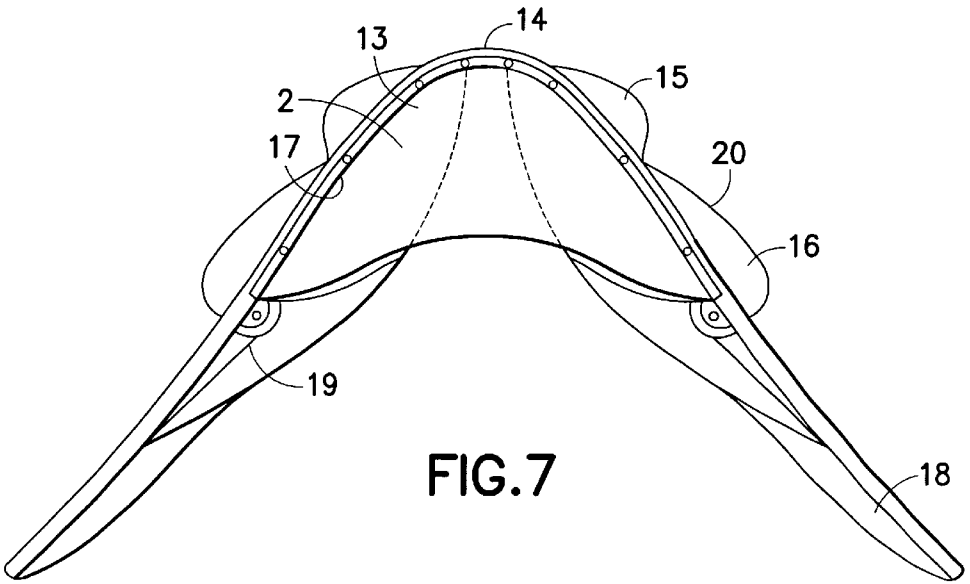
FIG. 7 is a transverse elevation view from the front, of a saddletree.
Figure 9:
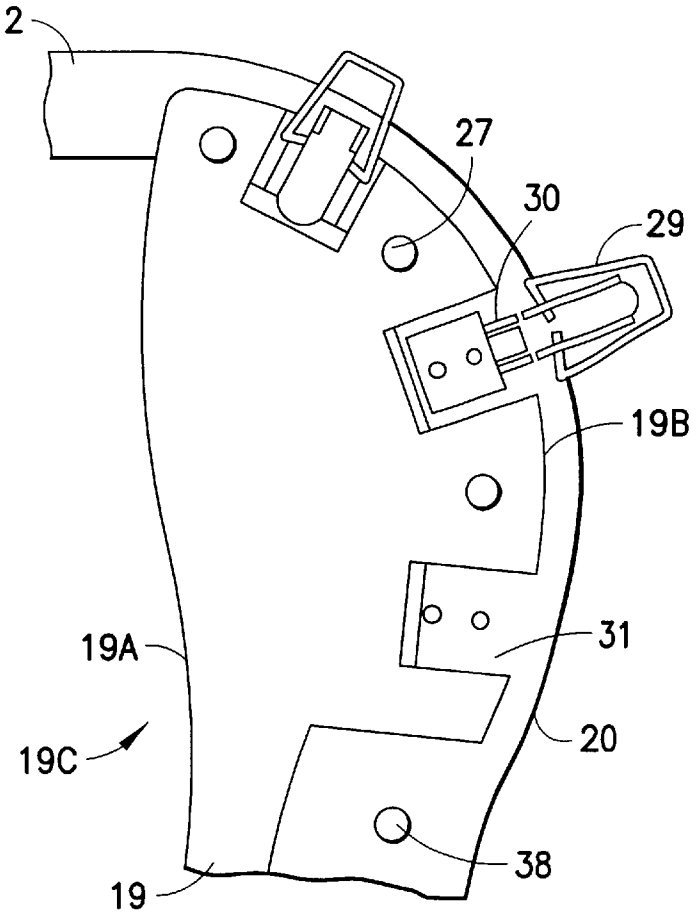
FIG. 9 is a partial plan view from below of a saddletree.
Figure 8:
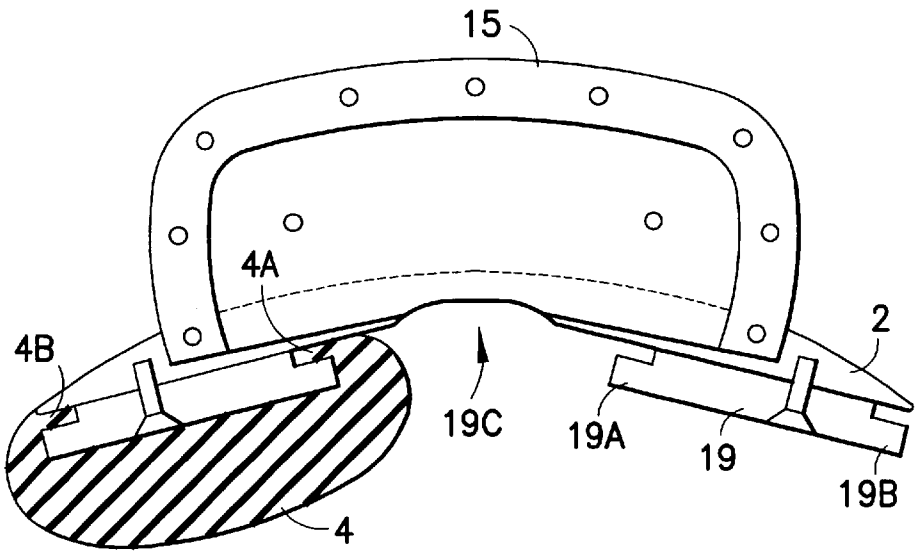
FIG. 8 is a transverse elevation view from behind, of a saddletree with a panel depicted in hatching, in an embodiment where the protrusions are attached to the saddletree.

The arch 17 and cantle 15 aim to wedge the rider in the seated position, by limiting the movements of his pelvis respectively forwards and backwards. They are connected together by a base 16 splayed in shape from front to rear, this base therefore being less broad transversely at the front than at the rear (FIG. 4). This shape makes the distribution of the weight of the rider uniform on the back of the horse, whilst providing a space for the legs of the rider at the front of the saddletree 2.

The arch 17, cantle 15 and base 16 can take shapes other than those described without departing from the context of the intention, provided that they fulfil notably the functions described above.

The arch backplate 11 and cantle backplate 12 (FIG. 2) are parts made of synthetic material, for example composite or the like, whose shapes are complementary respectively to the arch 17 and cantle 15.

On its internal face, the saddletree 2 has at least one protrusion 19, notably two, extending longitudinally along the longitudinal edges 20 of the saddletree and/or base, and with a transverse section substantially in the shape of a T.

In one embodiment (FIG. 5), the protrusions 19 extend substantially over the entire length of the saddletree 2. Their top edges 19A are substantially rectilinear and parallel to each other, whilst their bottom edges 19B follow substantially the contours of the saddletree.

Figure 10:
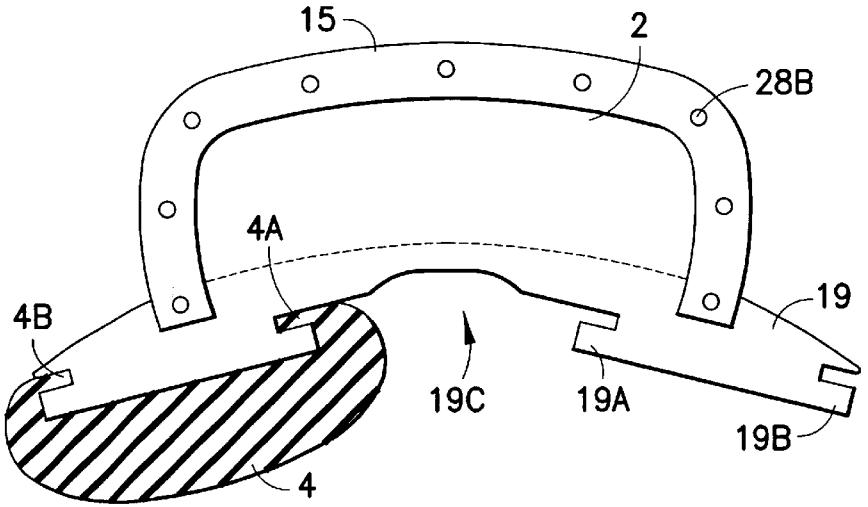
FIG. 10 is a view, similar to FIG. 8, in an embodiment where the protrusions are made in one piece with the saddletree.

In another embodiment (FIG. 10), the protrusions 19 are made in one piece with the single-piece part 13.

In a variant, the protrusions 19 are distinct from the single-piece part 13. The protrusions 19 are then attached below the single-piece part 13 and fixed to the latter by screwing, snapping on or the like. The materials used for producing the protrusions 19 can then be identical, or different from those used for producing the single-piece part 13.

For example, the protrusions 19 can be produced from rigid, semi-rigid or flexible materials, such as polymers, elastomers, metal, composite materials or the like, or from a combination of such materials.

The purpose of the protrusions 19 is to cooperate with the panels 4, to provide, along the internal face of the saddletree 2, and in its central part, a passage 19C for the backbone of the horse. It also provides for the positioning of the panels 4 on the saddletree 2.

Each panel 4 is a piece made of moulded rubber, polymer foam or the like, clad in leather, substantially in an S-shape longitudinally, and whose front part is reinforced by a frame made of wood or equivalent.

Figure 11:
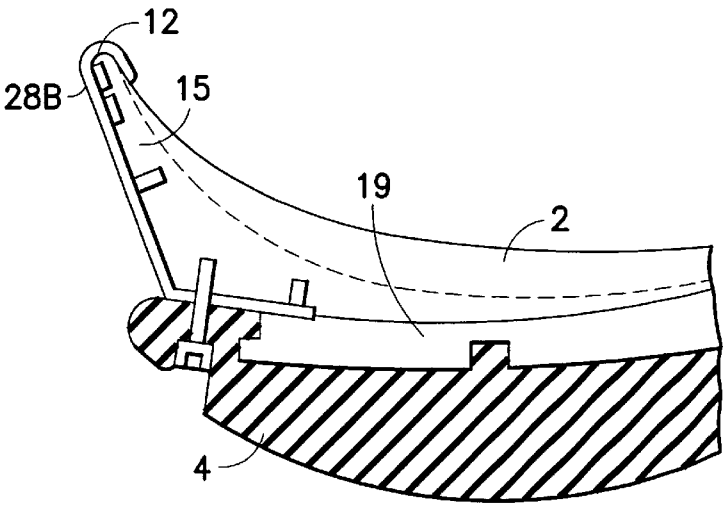
FIG. 11 is a longitudinal elevation view in partial section of constituent parts of a saddle, including a saddletree, a panel and a cantle backplate.
Figure 14:
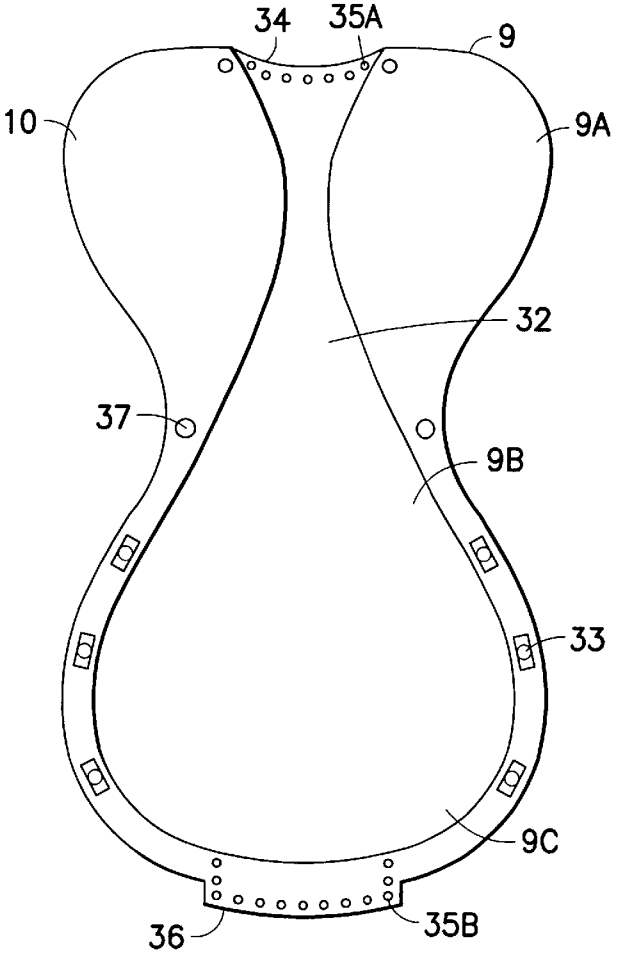
FIG. 14 is a plan view from below of a saddle seat.

In one embodiment, two panels 4 are provided, each being intended to cooperate with a protrusion 19. These panels 4 are fixed to the saddletree 2 removably, by screwing, snapping on or the like. As is clear in FIGS. 10 and 11, the top face of a panel 4 has a shape complementary to the corresponding protrusion 19 of the saddletree 2.

Each panel 4 also comprises longitudinal lips, respectively upper 4A and lower 4B, whose shape is substantially complementary respectively to the top 19A and bottom 19B edges of the protrusions, in order to provide the positioning and holding of the panel 4 on the saddletree 2.

Each panel 4 defines, at the front of the saddle 1, an overhang in line with the saddletree 2, in order to provide, between the saddle 1 and the horse, a maximum internal contact surface.

Another function of the protrusions 19 is to enable the saddletree 2—namely the part 13—to incorporate removable positing and fixing members 21 for the other parts making up the saddle 1. These members 21 confer on the saddletree 2—namely the part 13—a "common trunk" function for adapting the saddle 1 to different types of horseriding, using the same saddletree 2.

It is thus possible to exchange on a saddle the flaps 5 and knee rolls 6, the girth leathers 7, the panels 4 and the seat 9, according co the wear on them, the morphology of the horse or its rider, or the requirements of the latter notably.

For example, it is possible to convert an English saddle into a saddle of the "Danloux" type, more suitable for jumping, by fitting to the saddle knee rolls 6 provided with protrusions known as "catches" for the front and rear holding of the leg of the rider.

For positioning and fixing the stirrup bars 3, girth leathers 7, flaps 5 and knee rolls 6 notably, the positioning and fixing members 21 are in the form of at least one hollow recess 22, 22A, 22B, 22C.

Such a hollow recess 22A, substantially rectangular in shape, is provided in the thickness of each longitudinal edge 20 of the base 16, notably towards the front of the saddletree 2 and on its external face. In addition, a housing 23 in the shape of a vertical T is hollowed out at the bottom of the recess 22A. The top end of the housing 23 is situated substantially half-way up the hollow recess 22A, whilst its bottom end is merged with the longitudinal edge 20 of the saddletree. The shape of the housing 23 is substantially complementary to a top end part of the girth leathers 7.

The mounting of the girth leathers 7 in such a hollow recess 22A is effected as follows.

A top end part of the girth leathers 7 and an attachment rod 24 passing through this end part are inserted in the housing 23. The recess 22A is closed and the girth leathers 7 held in position by a plate 25 complementary to the recess 22A, fixed to the latter by removable fixing means such as screwing, snapping on or the like.

In an embodiment where the stirrup bars 3 are distinct from the saddletree 2 and attached, another hollow recess 22B is provided in each tip 18 of the saddletree 2, in order to cooperate with an end part of the stirrup bar. The stirrup bars 3 are then fixed to the saddletree 2 in this recess 22B by removable fixing means such as screwing or the like.

Figure 16:
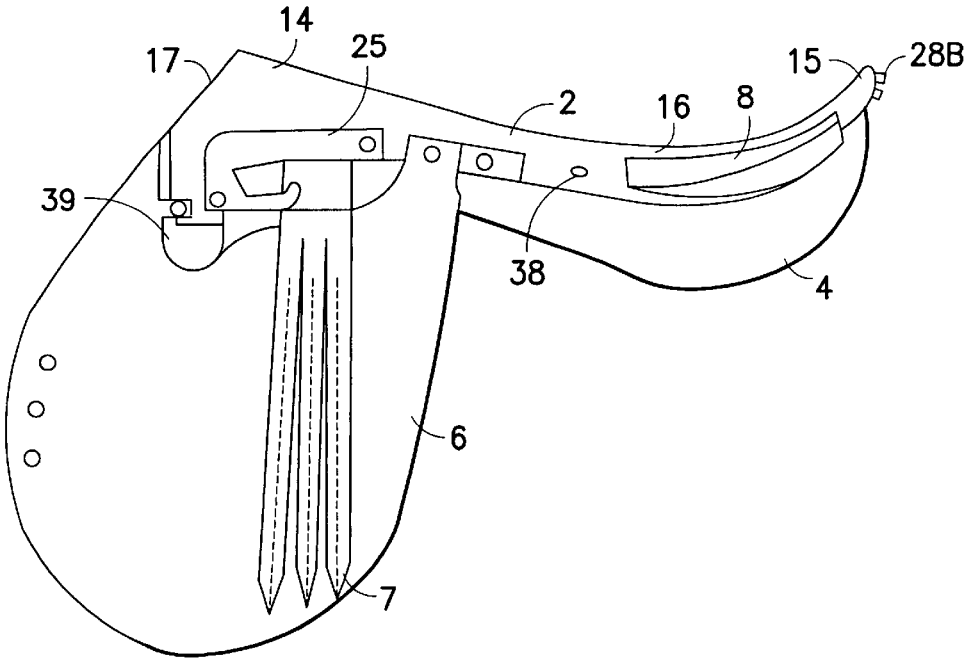
Figure 17:
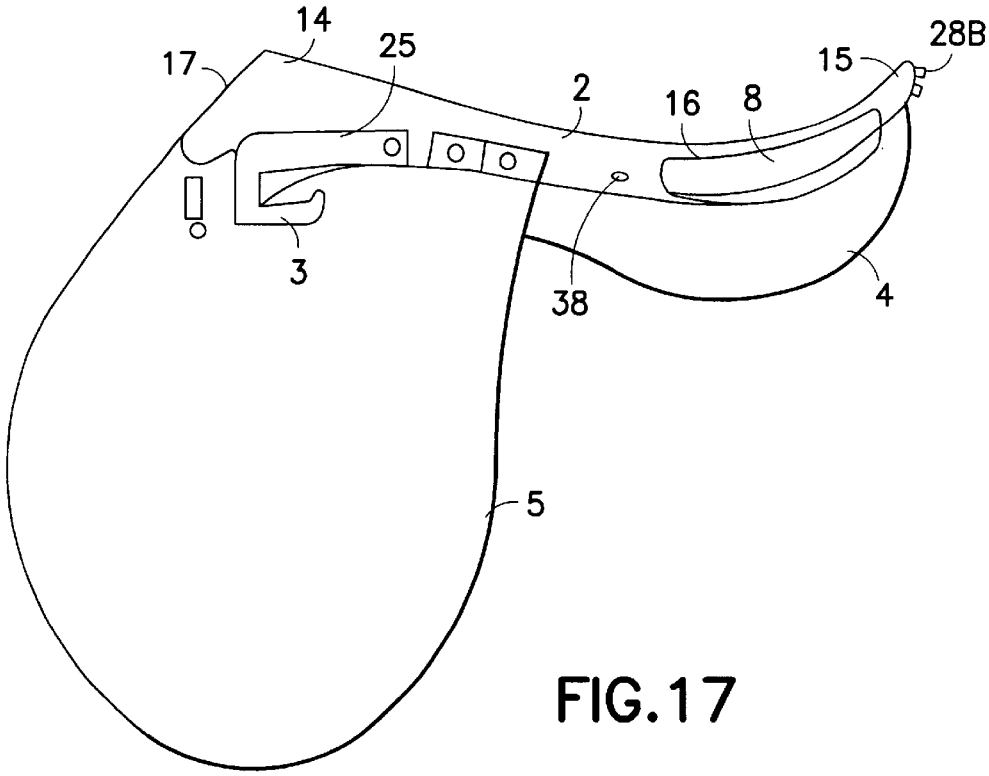

Another hollow recess 22C is provided in the thickness of each longitudinal edge 20 of the base 16, notably in its middle part, in order to cooperate with an end part of the flaps 5 and knee rolls 6. This recess 22C has also a substantially rectangular shape longitudinally. The flaps 5 and knee rolls 6 comprise top end parts whose shape is substantially complementary to such a recess 22C (FIGS. 16, 17). The flaps 5 and knee rolls 6 are fixed in this hollow recess 22C by removable fixing means, such as screwing, mutual attachment strips known by the registered trademark Velcro®, or the like.

In one possible embodiment, the sane recess 22 is intended to cooperate with an end part of a girth leather 7 and an attachment rod 24 for the latter, with an end part of a flap 5 and a knee roll 6 and/or an end part of a stirrup bar 3, this recess 22 then being closed by a single plate 25, by removable fixing means such as screwing, snapping on or the like.

In a variant (FIG. 4), the plate 25 forms a stirrup bar. It is then substantially in a U shape, one leg of which serves as a stirrup bar.

The depth of the recess or recesses 22, 22A, 22B, 22C, measured in the thickness of the saddletree 2, is such that, once mounted, the stirrup bars 3, the flaps 5 and knee rolls 6, the girth leathers 7 and the plate or plates 25, the external surfaces of these parts are flush with the top surface of the saddletree 2. This is aimed at guaranteeing optimum comfort for the rider, whilst avoiding the superimposition of the constituent parts of the saddle 1 causing uncomfortable and unattractive protrusions on the latter.

Figure 2:
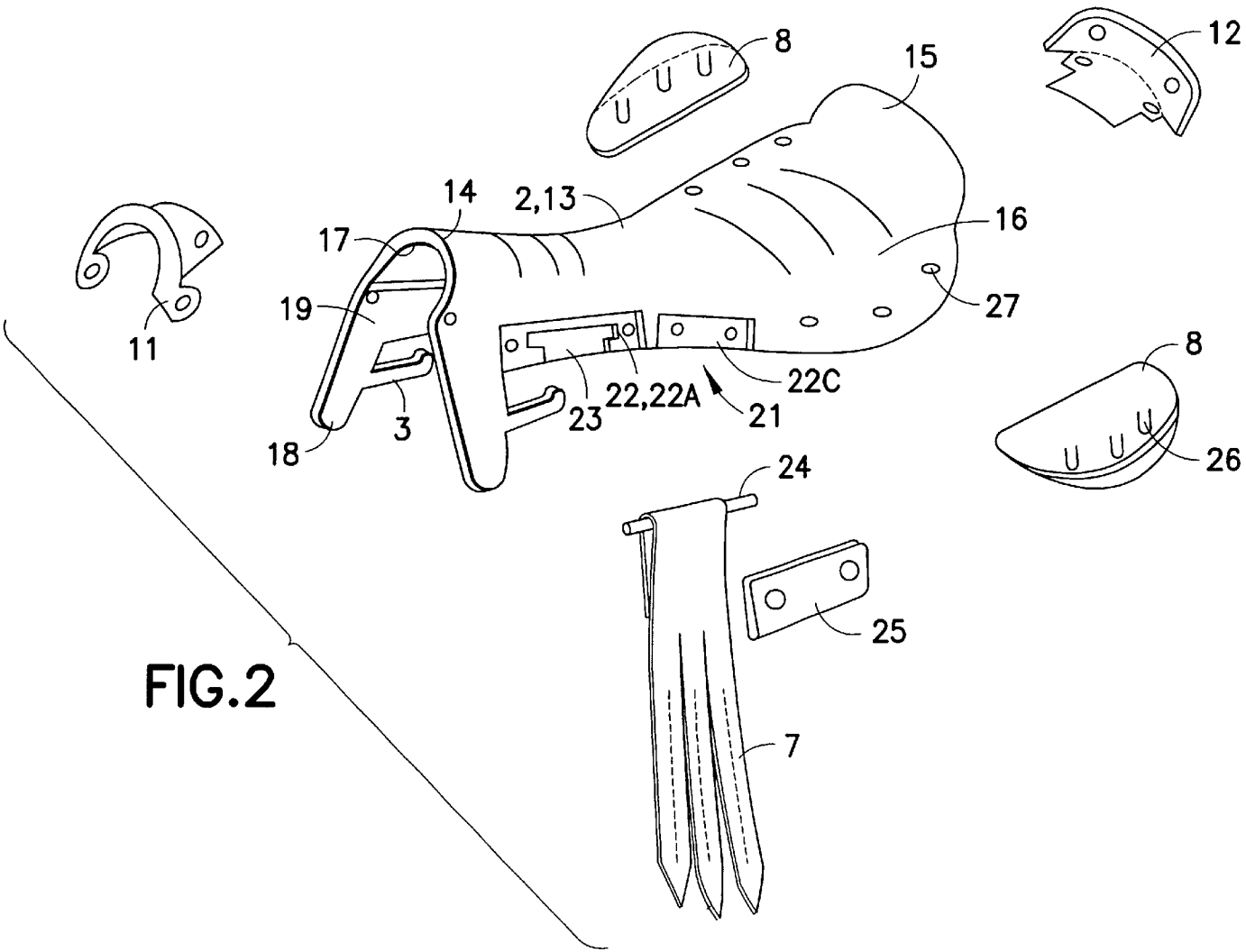
FIG. 2 is a view in exploded perspective of the constituent parts of a saddle according to a first embodiment, where the stirrup bars are made in one piece with the saddletree.
Figure 12:
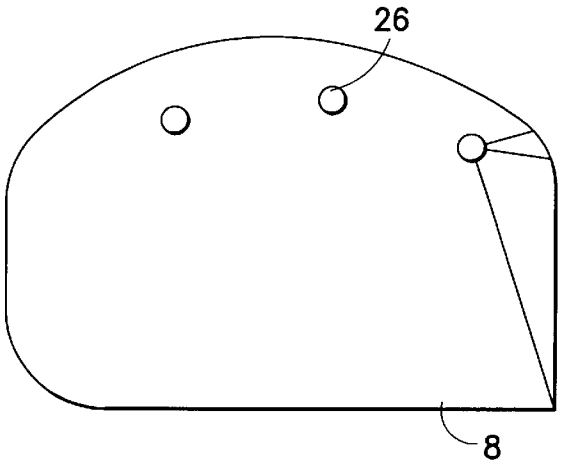
FIG. 12 is a plan view from below of a saddle padding piece.
Figure 13:
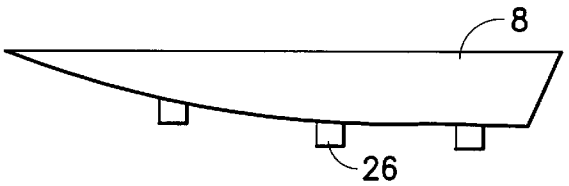
FIG. 13 is a view in longitudinal elevation of a saddle padding piece.
Figure 15:
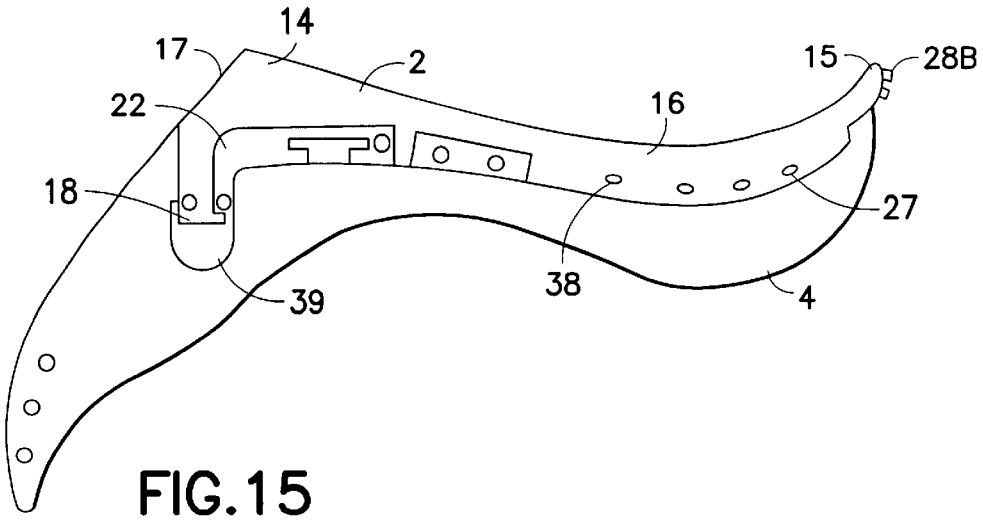
FIGS. 15 to 17 are views in longitudinal elevation of elements making up a saddle and representing successive steps of making up such a saddle.

The comfort of the saddle 1 is improved by the addition to the saddletree 2 of at least one, notably two stuffing pieces known as "padding" 8 (FIGS. 2, 12 and 13). These padding pieces 8 are produced from foam, rubber or the like. They have a contour with a shape which is generally substantially rectangular, and lie in a substantially horizontal plane. Their thickness is not uniform: their bottom face in fact conforms to the top face of the base 16. The shape of the padding pieces in such that, once they are in position on the saddletree 2, their top surface is substantially continuous with the top surface of the saddletree 2. Their external contour substantially conforms to the shape of the longitudinal edge 20 of the adjacent saddletree 2. The shape and material of the padding 8 can be adapted to the morphology and requirements of the rider.

For their positioning on the saddletree 2, the padding pieces 8 comprise three rigid pins 26 made of wood, plastics material or the like, substantially cylindrical in shape, protecting from the bottom face of the padding piece or pieces 8. The saddletree 2 is provided, close to its longitudinal edges 20, towards the rear of the base 16, with three holes in each longitudinal edge, each hole 27 being substantially complementary to a pin 26.

In another embodiment, the padding pieces 8 are held in position on the saddletree 2 by means of strips of the Velcro® type.

In one embodiment (FIG. 1) the padding pieces 8 are held on the saddletree 2 notably by the seat 9, where the latter is fixed to the saddletree over the padding pieces 8.

For positioning and fixing the seat 9 on the saddletree 2, the latter is provided, on its bottom face and along the periphery of the arch 17, with a plurality of spikes 28A, here cylindrical and metallic, projecting from and substantially perpendicular to this face.

In addition, the cantle 15 is also provided, on its external face, and along its top periphery at least, with such spikes 28B, projecting from and substantially perpendicular to this face.

Moreover, the saddletree 2 is provided, on its internal face, substantially on each of its longitudinal edges and towards the rear of the base 16, with at least one buckle 29, notably three buckles. The buckles 29 are fixed to the saddletree 2, for example screwed thereto, the principal direction of each buckle then being substantially perpendicular to the longitudinal edge 20 of the saddletree 2.

The buckle or buckles 29 are articulated about a shaft 30 substantially parallel to the longitudinal edge 20, this shaft enabling the buckle 29 to adopt two positions, a closed position and an open position.

Each buckle 29 is inserted in a hollow 31 provided in the corresponding protrusion 19 on the saddletree 2, so that, once closed, the buckle does not project from the hollow 31 towards the inside.

The seat 9 is a piece of leather whose shape is such that it entirely covers the saddletree 2, once positioned on the latter, the front 9A and rear 98 parts of the seat being broader than its middle part 9C.

The front part 9A of the seat 9 defines on each side laterally two skirts 10 forming protrusions.

When the seat 9 is in position on the saddle 1, the skirts 10 fall freely on each side of the front of the saddle, covering the stirrup bars 3, which they thus isolate from the legs of the rider.

A padding 32 made of foam, rubber or equivalent is fixed to the bottom face of the seat 9, by stitching, gluing or the like. This padding 32, splayed in shape form front to rear, improves the comfort of the saddle. It covers substantially all the rear part 9B of the seat 9, whilst it covers, on the front part 9A of the seat 9, a localised surface between the skirts 10.

At least one (notably three) hooks 33 are fixed to the seat 9 by riveting or the like, in its rear part 9B, on its bottom face and close to each of its longitudinal edges. The hook or hooks 33 are complementary to a buckle 29. The front end 34 of the seat of the saddle 1, corresponding in shape to the arch, is provided with holes 35A complementary to the spikes 28A on the saddletree 2. The rear end 36 of the seat 9 of the saddle 1 is also provided with such holes 35B, corresponding to the spikes 28B on the cantle 15 of the saddletree 2. In addition, the seat 9 can have, in its middle part, for example close to each of its longitudinal edges, snapping-on means 37 able to cooperate with holes 38 provided opposite in the base of the saddletree 2, in order notably to optimise the positioning and fixing of the seat 9 on the saddletree 2. Mounting of the seat 9 on the saddletree 2 is effected as follows.

The seat 9 is positioned on the saddletree 2, the holes 35A, 35B and the hooks 33 being respectively placed opposite the spikes 28A, 28B and the open buckles 29 of the saddletree. The front end 34 of the seat 9 is folded under the arch 17, each spike 28A Being inserted in a hole 35A. The rear end 36 of the seat 9 is folded behind the saddletree A, each spike 28B being inserted in a hole 35B.

The seat 9 is fixed to the arch 17 and to the cantle 15 respectively by a pommel backplate or arch backplate 11 and a cantle backplate 12. The arch backplate 11 and cantle backplate 12 cover the respectively front and rear ends of the seat, and are removably fixed to the saddletree 2, by screwing, snapping on or the like.

Each buckle 29 is inserted in a hook 33 and then closed. The seat 9 is thus fixed to the base 16.

The saddle 1 of the invention can be fully assembled or disassembled as required around its master piece, the saddletree 2, consisting essentially of the single-piece or integral part 13.

The progressive making up of the saddle 1, illustrated in FIGS. 15 to 18, is effected as follows.

Where the stirrup bars 3 are separate from the saddletree 2, they are fixed to the latter by screwing or the like.

The panels 4 are fixed inside the bare saddletree 2, the saddletree tips 18 being inserted in positioning receptacles 39 provided in each panel.

The knee rolls 6 are then positioned and then fixed, for example by screwing at lest one of their top end parts, on the one hand to the arch in the hollow recesses 22C, and on the other hand to a corresponding panel 4, for example on an overhang on this panel.

The girth leathers 7 are then fixed in the corresponding hollow recesses 22A, which are closed by their respective plates 25.

The flaps 5 are then fixed to the arch in the same way as the knee rolls 6, in the hollow recesses 22C, so that the stirrup bars 3 then appear outside the flaps.

The padding pieces 8 are positioned on the base 16, their pins 26 being inserted in the corresponding holes 27.

The seat 9 is then positioned or, the saddletree 2, and then fixed to the base 16 by means of buckles 29.

Finally, the pommel backplate 11 and cantle backplate 12 cover the arch 27 and cantle 15, trapping the ends of the seat 9 in and/or on the latter.

Although this description has been given in consideration of parts (panel, girth leathers, flaps and knee rolls, seat) made of leather, these can be made of leather substitute or the like.

What is claimed is:

1. A saddletree for producing a saddle, notably for horses, the saddletree comprising a single-piece part forming a pommel, a cantle, a base and support means for other parts making up the saddle, wherein the single-piece part is produced from materials shaped to a required shape for the saddletree, conferring on the saddletree qualities of strength and flexibility to support, in a peripheral part of the single-piece part the support means for positioning and removably-attaching the other parts making up the saddle, including panels, flaps, knee rolls, girth leathers, padding, seat, skirts, pommel and cantle backplates, the support means comprising holes, spikes, hollow recesses, reliefs, screwing inserts, and buckles, so that the other parts making up the saddle are positioned and attached to the single-piece part by the support means;

wherein the support means has means for attaching the girth leathers that comprise a hollow recess arranged to allow mounting of an attachment rod for the girth leathers, the attachment rod being held in place by removable fixing means, and wherein for each girth leather, the hollow recess is arranged to have at least one attached plate for closing the hollow recess, fixed to the single-piece part by removable attachment members.

2. A saddletree according to claim 1, characterised in that the materials of the integral single-piece part (13) are chosen from the group comprising polyamide fibers in sheets, composite materials in sheets such as materials comprising a matrix, metallic or polymeric, and reinforcement glass or carbon fibers.

3. A saddletree according to claim 1, characterised in that the single-piece part (13) is substantially solid.

4. A saddletree according to claim 1, characterised in that the single-piece part (13) has a thicker peripheral part (19) around a central thinner part, so as to provide a passage for the backbone of the horse, to provide the positioning of the saddle panels on the saddletree and, finally, to allow incorporation of the members (21) into the piece (13).

5. A saddletree according to claim 1, characterised in that the single-piece part (13) is shaped so as to incorporate, in manufacture, the stirrup bars (3).

6. A saddletree according to claim 1, characterised in that the single-piece part (13) does not incorporate, in manufacture, stirrup bars (3), the latter being distinct and attached.

7. A saddle, notably for a horse, comprising a saddletree according to claim 1, comprising the integral single-piece part provided with the removable positioning and attachment support means, two stirrup bars selectably incorporated into the single-piece part of the saddletree, two panels attached against the internal face of the saddletree, one or more padding pieces selectably connected to the external face of the saddletree, two flaps and two knee rolls disposed laterally, two girth leathers disposed laterally towards the pommel and a piece forming a seat covering the external face of the saddletree, the panels, the padding piece or pieces, the flaps and knee rolls, the girth leathers and the piece forming a seat being attached by the removable support means complementary to positioning fixing members incorporated in the single-piece part of the saddletree.

8. A saddle according to claim 7, characterised in that the saddle also has two backplates respectively for the pommel and cantle, attached to the single-piece part of the saddletree by fixing means and cooperating with the seat, and protecting seat fixing means.

9. A saddle according to claim 7, characterised in that the support means for attaching the panels, the padding piece or pieces, the flaps and knee rolls and the piece forming a seat, are selected from the group consisting of screws passing through holes in the corresponding piece, pins, reliefs, holes, and hooks.

10. A saddle according to claim 7 characterised in that the means for attaching a girth leather (7) comprise a hollow recess (22; 22A) arranged to allow the mounting of an attachment rod (24) for the girth leather, the rod being held in place by removable fixing means.

11. A saddle according to claim 7, in which the stirrup bars are distinct and attached to the single-piece part of the saddletree, characterised in that the single-piece part has a hollow recess in which an end fixing part of one of the stirrup bars is placed, and held in place by removable attachments means.

12. A saddle according to claim 7, characterised by a common hollow recess (22), provided in the single-piece part (13) of the saddletree (2) with a girth leather (7) and an adjoining stirrup bar (3), and a common closure plate (25) for this hollow recess.

13. A saddle comprising:

a saddletree having a single-piece part forming a pommel, a cantle, a base and support means for other parts making up the saddle, the support means being disposed on a peripheral part of the single-piece part for positioning and removably attaching the other parts making up the saddle, the support means comprising holes, spikes, hollow recesses, reliefs, screwing inserts, and buckles, so that the other parts making up the saddle are positioned and attached to the single-piece part by the support means;

two stirrup bars selectably incorporated into the single-piece part, two panels attached against an internal face of the saddletree, one or more padding pieces selectively connected to an external face of the saddletree, two flaps and two knee rolls disposed laterally, two girth leathers disposed laterally towards the pommel and a piece forming a seat covering the external face of the saddletree, the panels, the padding piece, the flaps and knee rolls, the girth leathers and the piece forming a seat being attached by the removable support means complementary to positioning fixing members incorporated in the single-piece part of the saddletree;

wherein the support means has means for attaching the girth leathers that comprise a hollow recess arranged to allow the mounting of an attachment rod for the girth leathers, the rod being held in place by removable fixing means, and characterised in that for each girth leather, the saddle has at least one attached plate for closing the hollow recess, fixed to the single-piece part by removable attachment members.

14. A saddle comprising:

a saddletree having a single-piece part forming a pommel, a cantle, a base and support means for other parts making up the saddle, the support means being disposed on a peripheral part of the single-piece part for positioning and removably attaching the other parts making up the saddle, the support means comprising holes, spikes, hollow recesses, reliefs, screwing inserts, and buckles, so that the other parts making up the saddle are positioned and attached to the single-piece part by the support means;

two stirrup bars selectably incorporated into the single-piece part of the saddletree, two panels attached against an internal face of the saddletree, one or more padding pieces selectably connected to an external face of the saddletree, two flaps and two knee rolls disposed laterally, two girth leathers disposed laterally towards the pommel and a piece forming a seat covering the external face of the saddletree, characterised in that the single-piece part has a hollow recess in which an end fixing part of a corresponding one of the stirrup bars is placed, and held in place by removable attachments means; and characterised in that for each stirrup bar, the saddle has at least one attached piece for closing the hollow recess, fixed to the single-piece part by a removable attachment member.

* * * * *